US010720759B2

(12) United States Patent
Imai

(10) Patent No.: US 10,720,759 B2
(45) Date of Patent: Jul. 21, 2020

(54) IGNITION PLUG

(71) Applicant: NGK SPARK PLUG CO., LTD., Nagoya-shi, Aichi (JP)

(72) Inventor: Susumu Imai, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/494,331

(22) PCT Filed: Aug. 8, 2017

(86) PCT No.: PCT/JP2017/028848

§ 371 (c)(1),
(2) Date: Sep. 16, 2019

(87) PCT Pub. No.: WO2018/168000

PCT Pub. Date: Sep. 20, 2018

(65) Prior Publication Data

US 2020/0083674 A1 Mar. 12, 2020

(30) Foreign Application Priority Data

Mar. 17, 2017 (JP) ..... 2017-053369

(51) Int. Cl.
*H01T 13/36* (2006.01)
*H01T 13/26* (2006.01)
*H01T 13/08* (2006.01)

(52) U.S. Cl.
CPC ..... *H01T 13/26* (2013.01); *H01T 13/08* (2013.01); *H01T 13/36* (2013.01)

(58) Field of Classification Search
CPC ..... H01T 13/26; H01T 13/08; H01T 13/36; H01T 13/20
See application file for complete search history.

(56) References Cited

U.S. PATENT DOCUMENTS 6,373,173 B1 4/2002 Suzuki
9,276,384 B2 3/2016 Kobayashi
(Continued)

FOREIGN PATENT DOCUMENTS

JP 2000-215963 A 8/2000
JP 2011-210699 A 10/2011
(Continued)

OTHER PUBLICATIONS

International Search Report from corresponding International Patent Application No. PCT/JP2017/028848, dated Oct. 31, 2017.

*Primary Examiner* — Donald L Raleigh
(74) *Attorney, Agent, or Firm* — Kusner & Jaffe

(57) ABSTRACT

The spark plug includes an insulator, a metal shell, and a buffering member. The buffering member is filled in a space that is enclosed by an inner peripheral surface of the metal shell and an outer peripheral surface of the insulator. 3 $mm^2 \leq L \times T$ is satisfied in a case where: a length in a direction of an axial line of a filled portion filled with the buffering member is defined as a filling length L; a thickness, of a screw portion of the metal shell, that is half a difference left after subtraction of the inner diameter of the metal shell from the pitch diameter of the screw portion is defined as an effective thickness; and a minimum value of the effective thickness of a portion, of the screw portion, present rearward of an inner diameter reduction portion of the metal shell is defined as a minimum thickness T.

8 Claims, 5 Drawing Sheets

(56) References Cited

U.S. PATENT DOCUMENTS

| | | | | |
|---|---|---|---|---|
| 9,306,375 | B2 | 4/2016 | Ozeki et al. | |
| 2008/0203882 | A1* | 8/2008 | Kobayashi | H01T 13/08 313/141 |
| 2008/0284305 | A1* | 11/2008 | Hoffman | H01T 21/02 313/141 |
| 2015/0188293 | A1 | 7/2015 | Ozeki et al. | |
| 2015/0295388 | A1 | 10/2015 | Kobayashi | |

FOREIGN PATENT DOCUMENTS

| | | | |
|---|---|---|---|
| JP | 2014-093137 | A | 5/2014 |
| WO | WO-2014/013654 | A1 | 1/2014 |

* cited by examiner (A) REFERENCE EXAMPLES

| D57 (mm) | Rc | Nc |
|---|---|---|
| 11 | A | 0/10 |
| 13 | A | 0/10 |
| 15 | B | 8/10 |
| 17 | B | 10/10 |
| 19 | B | 10/10 |
| 21 | B | 10/10 |

(B)

| D57 (mm) | Rc | Nc |
|---|---|---|
| 11 | A | 0/10 |
| 13 | A | 0/10 |
| 15 | A | 0/10 |
| 17 | A | 0/10 |
| 19 | A | 0/10 |
| 21 | A | 0/10 |
| 23 | A | 0/10 |
| 25 | A | 0/10 |
| 27 | A | 0/10 |

FIG. 5

IGNITION PLUG

FIELD OF THE INVENTION

The present specification relates to a spark plug for an internal combustion engine.

BACKGROUND OF THE INVENTION

The size and the diameter of a spark plug used for an internal combustion engine have been required to be reduced for the purpose of improvement in the degree of freedom in designing of the internal combustion engine and the like. For example, by reducing the diameter of the spark plug, the diameter of a mounting hole into which the spark plug is to be mounted can be reduced, and thus the degree of freedom in designing of an intake port and an exhaust port can be improved. By reducing the size and the diameter of the spark plug, the diameters of an insulator and a metal shell can be reduced, and thus the mechanical strengths of the insulator and the metal shell are reduced. A technique has been proposed in which a seal member is provided in order to improve sealability between an insulator and a metal shell in such a case, the seal member being provided between: a diameter reduction portion (specifically, a portion having an inner diameter that reduces toward a front side), of the metal shell, which is formed by a projecting portion projecting radially inward; and a diameter reduction portion, of the insulator, which has an outer diameter that reduces toward the front side. Specifically, the tilt of the diameter reduction portion of the metal shell with respect to an axial line of the spark plug is made gentler than the tilt of the diameter reduction portion of the insulator with respect to the axial line, so that load that is received from the seal member by the diameter reduction portion of the metal shell becomes smaller on the inner peripheral side than on the outer peripheral side. As a result, deformation of the projecting portion of the metal shell is suppressed. Prior art is disclosed in International Publication WO 2014/013654 ("Patent Document 1").

Incidentally, when a spark plug is manufactured, force is applied to a part (e.g., rear end portion) of a metal shell so as to bend the part in order to fix an insulator to the metal shell. For example, the rear end portion of the metal shell is crimped. Such force is transmitted from the metal shell to the insulator so that the insulator can be pressed frontward against the metal shell. Accordingly, a diameter reduction portion of the insulator can press a diameter reduction portion of the metal shell frontward. The metal shell is sometimes deformed owing to such force. When a screw portion formed on the outer peripheral surface of the metal shell is deformed, it sometimes becomes difficult to appropriately mount the spark plug into a mounting hole of an internal combustion engine.

SUMMARY OF THE INVENTION

The present specification discloses a technique that enables deformation of a screw portion of a metal shell to be suppressed.

The present specification discloses the following application examples, for example.

Application Example 1

A spark plug including:

an insulator having a through hole extending in a direction of an axial line, the insulator including a first outer diameter reduction portion having an outer diameter that reduces from a rear side toward a front side, and a second outer diameter reduction portion positioned rearward of the first outer diameter reduction portion and having an outer diameter that reduces from the front side toward the rear side;

a metal shell disposed on an outer periphery of the insulator and having a through hole into which the insulator is inserted and which extends in the direction of the axial line, the metal shell including an inner diameter reduction portion having an inner diameter that reduces from the rear side toward the front side, the inner diameter reduction portion directly or indirectly supporting the first outer diameter reduction portion of the insulator, a rear end portion positioned rearward of the second outer diameter reduction portion of the insulator so as to form a rear end of the metal shell, the rear end portion being bent radially inward, and a screw portion formed on an outer peripheral surface thereof; and a buffering member filled in a space that is present between the rear end portion of the metal shell and the second outer diameter reduction portion of the insulator and that is enclosed by an inner peripheral surface of the metal shell and an outer peripheral surface of the insulator, wherein $3\ mm^2 \leq L \times T$ is satisfied in a case where:

a length in the direction of the axial line of a filled portion filled with the buffering member is defined as a filling length L;

a thickness, of the screw portion of the metal shell, that is half a difference left after subtraction of an inner diameter of the metal shell from a pitch diameter of the screw portion is defined as an effective thickness; and a minimum value of the effective thickness of a portion, of the screw portion, present rearward of the inner diameter reduction portion is defined as a minimum thickness T.

When force is applied to the rear end portion of the metal shell in order to bend the rear end portion, the force is transmitted to the insulator via the buffering member so that the insulator is pressed frontward against the metal shell. The first outer diameter reduction portion of the insulator presses the inner diameter reduction portion of the metal shell frontward, and thus a portion, of the metal shell, that is present rearward of the inner diameter reduction portion can be deformed. With the above-described configuration, deformation of the screw portion can be suppressed through adjustment of the filling length L and the minimum thickness T of the portion, of the screw portion, that is present rearward of the inner diameter reduction portion.

Application Example 2

The spark plug according to application example 1, wherein $4\ mm^2 \leq L \times T$ is satisfied.

With this configuration, deformation of the screw portion can be further suppressed.

Application Example 3

The spark plug according to application example 1 or 2, wherein the minimum thickness T is not larger than 1.3 mm.

With the above-described configuration, deformation of the screw portion can be suppressed even in the spark plug in which the minimum thickness T is not larger than 1.3 mm.

Application Example 4

The spark plug according to any of application examples 1 to 3, wherein a length in the direction of the axial line of the screw portion is not smaller than 15 mm.

Since deformation of the screw portion is suppressed through adjustment of the minimum thickness T and the filling length L, a metal shell including a screw portion having a length not smaller than 15 mm can be used.

The technique disclosed in the present specification can be embodied in various forms, and can be embodied in forms such as: a spark plug; an ignition device using the spark plug; an internal combustion engine equipped with the spark plug; and an internal combustion engine equipped with the ignition device using the spark plug.

BRIEF DESCRIPTION OF THE DRAWINGS

FIG. 5 are tables indicating the correspondence relationship between the configurations of samples of the spark plug and the test results.

DETAILED DESCRIPTION OF THE INVENTION

A. Embodiment

Figure 1:
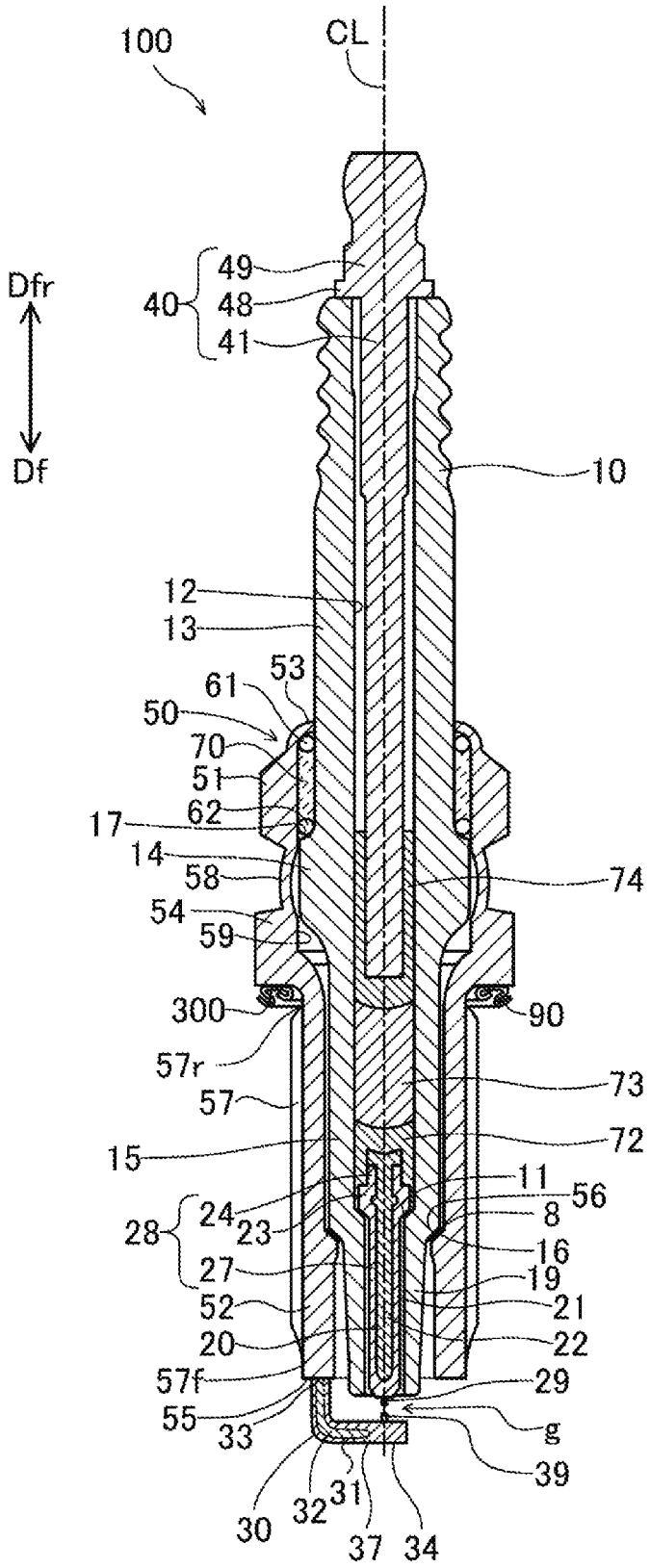
FIG. 1 is a cross-sectional view of a spark plug 100 according to one embodiment.

A-1. Configuration of Spark Plug 100:

FIG. 1 is a cross-sectional view of a spark plug 100 according to one embodiment. In the drawing, a central axis CL (referred to also as "axial line CL") of the spark plug 100, and a flat cross section including the central axis CL of the spark plug 100, are shown. Hereinafter, a direction parallel to the central axis CL is referred to also as a "direction of the axial line CL", or simply referred to also as an "axial direction" or a "frontward/rearward direction". A radial direction of a circle centered on the axial line CL is referred to also as a "radial direction". The radial direction is a direction perpendicular to the axial line CL. A circumferential direction of a circle centered on the axial line CL is referred to also as a "circumferential direction". In the direction parallel to the central axis CL, the downward direction in FIG. 1 is referred to as a front end direction Df or a frontward direction Df, and the upward direction in FIG. 1 is referred to also as a rear end direction Dfr or a rearward direction Dfr. The front end direction Df is a direction from a metal terminal 40 described later toward a center electrode 20 described later. In addition, a front end direction Df side in FIG. 1 is referred to as a front side of the spark plug 100, and a rear end direction Dfr side in FIG. 1 is referred to as a rear side of the spark plug 100.

The spark plug 100 includes: a tubular insulator 10 having a through hole 12 (referred to also as an axial hole 12) extending along the axial line CL; the center electrode 20 held on the front side of the through hole 12; the metal terminal 40 held on the rear side of the through hole 12; a resistor 73 disposed in the through hole 12 so as to be located between the center electrode 20 and the metal terminal 40; a conductive first seal portion 72 which is in contact with the center electrode 20 and the resistor 73 so as to electrically connect these members 20 and 73 to each other; a conductive second seal portion 74 which is in contact with the resistor 73 and the metal terminal 40 so as to electrically connect these members 73 and 40 to each other; a tubular metal shell 50 fixed to the outer peripheral side of the insulator 10; and a ground electrode 30 which has one end joined to a front end surface 55 of the metal shell 50 and has the other end located so as to be opposed to the center electrode 20 with a gap g therebetween.

Substantially at the center in the axial direction of the insulator 10, a large-diameter portion 14 is formed so as to have the largest outer diameter. On the rear side relative to the large-diameter portion 14, an outer diameter reduction portion 17 and a rear-side trunk portion 13 are formed in this order toward the rear side. At the outer diameter reduction portion 17, the outer diameter of the insulator 10 gradually reduces toward the rearward direction Dfr side. On the front side relative to the large-diameter portion 14, a front-side trunk portion 15 is formed so as to have a smaller outer diameter than the rear-side trunk portion 13. On the further front side relative to the front-side trunk portion 15, an outer diameter reduction portion 16 and a leg portion 19 are formed in this order toward the front side. The outer diameter of the outer diameter reduction portion 16 gradually reduces in the frontward direction Df. Near the outer diameter reduction portion 16 (in the example in FIG. 1, the front-side trunk portion 15), an inner diameter reduction portion 11 is formed so as to have an inner diameter that gradually reduces in the frontward direction Df. The insulator 10 is preferably formed in consideration of mechanical strength, thermal strength, and electrical strength, and is formed by baking alumina, for example (another insulating material may be used).

The center electrode 20 is a metallic member and is disposed at an end portion on the frontward direction Df side in the through hole 12 of the insulator 10. The center electrode 20 includes a substantially columnar rod portion 28, and a first tip 29 joined (by laser welding, for example) to the front end of the rod portion 28. The rod portion 28 includes a head portion 24 which is a portion on the rearward direction Dfr side, and an axial portion 27 connected to the frontward direction Df side of the head portion 24. The axial portion 27 extends in the frontward direction Df parallelly to the axial line CL. A portion on the frontward direction Df side of the head portion 24 forms a flange portion 23 having an outer diameter larger than the outer diameter of the axial portion 27. A surface on the frontward direction Df side of the flange portion 23 is supported by the inner diameter reduction portion 11 of the insulator 10. The axial portion 27 is connected to the frontward direction Df side of the flange portion 23. The first tip 29 is joined to the front end of the axial portion 27.

The rod portion 28 includes an outer layer 21, and a core portion 22 located on the inner peripheral side of the outer layer 21. The outer layer 21 is formed from a material (e.g., an alloy containing nickel as a main component) having higher oxidation resistance than the core portion 22. Here, the main component means a component of which the content (percent by weight (wt %)) is highest. The core portion 22 is formed from a material (e.g., pure copper or an alloy containing copper as a main component) having a higher coefficient of thermal conductivity than the outer layer 21. The first tip 29 is formed from a material (e.g., a noble metal such as iridium (Ir) or platinum (Pt)) having higher durability against electric discharge than the axial portion 27. A front-side portion, of the center electrode 20, that includes the first tip 29 is exposed from the axial hole 12 of the insulator 10 toward the frontward direction Df side. The core portion 22 may be omitted. In addition, the first tip 29 may be omitted.

The metal terminal 40 is a rod-like member extending parallelly to the axial line CL. The metal terminal 40 is formed from a conductive material (e.g., a metal containing iron as a main component). The metal terminal 40 includes a cap mounting portion 49, a flange portion 48, and an axial portion 41 which are arranged in this order in the frontward direction Df. The axial portion 41 is inserted in a portion on the rearward direction Dfr side of the axial hole 12 of the insulator 10. From the rear side of the insulator 10, the cap mounting portion 49 is exposed to the outside of the axial hole 12.

In the axial hole 12 of the insulator 10, the resistor 73 for suppressing electrical noise is disposed between the metal terminal 40 and the center electrode 20. The resistor 73 is formed from a conductive material (e.g., a mixture of glass, carbon particles, and ceramic particles). The first seal portion 72 is disposed between the resistor 73 and the center electrode 20, and the second seal portion 74 is disposed between the resistor 73 and the metal terminal 40. These seal portions 72 and 74 are formed from a conductive material (e.g., a mixture of metal particles and the same glass as that contained in the material of the resistor 73). The center electrode 20 is electrically connected to the metal terminal 40 by the first seal portion 72, the resistor 73, and the second seal portion 74.

The metal shell 50 is a tubular member having a through hole 59 extending along the axial line CL. The insulator 10 is inserted in the through hole 59 of the metal shell 50, and the metal shell 50 is fixed to the outer periphery of the insulator 10. The metal shell 50 is formed from a conductive material (e.g., a metal such as carbon steel which contains iron as a main component). A part on the frontward direction Df side of the insulator 10 is exposed to the outside of the through hole 59. A part on the rearward direction Dfr side of the insulator 10 is exposed to the outside of the through hole 59.

The metal shell 50 includes a tool engagement portion 51 and a front-side trunk portion 52. The tool engagement portion 51 is a portion to which a wrench (not shown) for spark plugs is to be fitted. The front-side trunk portion 52 is a portion including the front end surface 55 of the metal shell 50. On the outer peripheral surface of the front-side trunk portion 52, a screw portion 57 which is to be screwed into a mounting hole of an internal combustion engine (e.g., gasoline engine) is formed. The screw portion 57 is a portion on which an external thread is formed so as to extend in the direction of the axial line CL.

A flange-like middle trunk portion 54 is formed on the outer peripheral surface, of the metal shell 50, between the tool engagement portion 51 and the front-side trunk portion 52 so as to protrude radially outward. The outer diameter of the middle trunk portion 54 is larger than the maximum outer diameter (i.e., an outer diameter at the crest of the thread ridge) of the screw portion 57. A surface 300 on the frontward direction Df side of the middle trunk portion 54 is a seating surface for forming a seal between the surface 300 and a mounting portion (e.g., engine head) which is a portion, of the internal combustion engine, in which a mounting hole is formed.

An annular gasket 90 is disposed between the screw portion 57 of the front-side trunk portion 52 and the seating surface 300 of the middle trunk portion 54. When the spark plug 100 is mounted to the internal combustion engine, the gasket 90 is squashed and deformed, thereby sealing a space between the seating surface 300 of the middle trunk portion 54 of the spark plug 100 and the mounting portion (e.g., engine head) of the internal combustion engine which is not shown. The gasket 90 may be omitted. In this case, the seating surface 300 of the middle trunk portion 54 directly comes into contact with the mounting portion of the internal combustion engine, so that the space between the seating surface 300 and the mounting portion of the internal combustion engine is sealed.

On the front-side trunk portion 52 of the metal shell 50, an inner diameter reduction portion 56 is formed such that the inner diameter thereof gradually reduces frontward. A front-side packing 8 is sandwiched between the inner diameter reduction portion 56 of the metal shell 50 and the outer diameter reduction portion 16 of the insulator 10. In the present embodiment, the front-side packing 8 is a plate-like ring made from iron, for example (another material (e.g., a metal material such as copper) may be used). The inner diameter reduction portion 56 of the metal shell 50 indirectly supports the outer diameter reduction portion 16 of the insulator 10 via the packing 8.

A crimp portion 53 which is a thin portion is formed on the rear side of the metal shell 50 relative to the tool engagement portion 51 (the crimp portion 53 is a rear end portion forming the rear end of the metal shell 50, and is hereinafter referred to also as a rear end portion 53). In addition, a buckling portion 58 which is a thin portion is formed between the middle trunk portion 54 and the tool engagement portion 51. Annular ring members 61 and 62 are inserted between: the inner peripheral surface, of the metal shell 50, from the tool engagement portion 51 to the crimp portion 53; and the outer peripheral surface of the rear-side trunk portion 13 of the insulator 10. Powder of talc 70 as an example of a buffering member is filled between these ring members 61 and 62. In a manufacturing process for the spark plug 100, when the crimp portion 53 is crimped to be bent inward, the buckling portion 58 is deformed (buckled) outward in association with application of compressive force, and as a result, the metal shell 50 and the insulator 10 are fixed to each other. The talc 70 is compressed in the crimping step, to improve the airtightness between the metal shell 50 and the insulator 10. In addition, the packing 8 is pressed between the outer diameter reduction portion 16 of the insulator 10 and the inner diameter reduction portion 56 of the metal shell 50, to seal a portion between the metal shell 50 and the insulator 10. In the completed spark plug 100 (i.e., after the crimping step), the compressed talc 70 causes force for pressing the insulator 10 in the frontward direction Df against the metal shell 50. That is, in the completed spark plug 100, the compressed talc 70 applies load on the packing 8. Accordingly, the airtightness provided by the packing 8 is inhibited from being reduced. Furthermore, the talc 70 functions as a buffering member that absorbs vibration. Accordingly, the insulator 10 and the metal shell 50 are inhibited from becoming less firmly fixed to each other.

The ground electrode 30 is a metallic member, and includes a rod-like body portion 37 and a second tip 39 attached to a distal end portion 34 of the body portion 37. The other end portion 33 (referred to also as a proximal end portion 33) of the body portion 37 is joined (e.g., by resistance welding) to the front end surface 55 of the metal shell 50. The body portion 37 extends in the front end direction Df from the proximal end portion 33 joined to the metal shell 50 and is bent toward the central axis CL, where the distal end portion 34 is present. The second tip 39 is fixed (e.g., by resistance welding or laser welding) to a portion on the rearward direction Dfr side of the distal end portion 34. A gap g is formed between the second tip 39 of the ground electrode 30 and the first tip 29 of the center electrode 20. That is, the second tip 39 of the ground electrode 30 is disposed on the frontward direction Df side relative to the first tip 29 of the center electrode 20, and is opposed to the first tip 29 with the gap g therebetween. The second tip 39 is formed from a material (e.g., a noble metal such as iridium (Ir) or platinum (Pt)) having higher durability against electric discharge than the body portion 37. The second tip 39 may be omitted.

The body portion 37 includes an outer layer 31 and an inner layer 32 disposed on the inner peripheral side of the outer layer 31. The outer layer 31 is formed from a material (e.g., an alloy containing nickel as a main component) having higher oxidation resistance than the inner layer 32. The inner layer 32 is formed from a material (e.g., pure copper or an alloy containing copper as a main component) having a higher coefficient of thermal conductivity than the outer layer 31. The inner layer 32 may be omitted.

A-2. Manufacturing Method:

Various methods may be each employed as a manufacturing method for the above-described spark plug 100. For example, the following manufacturing method may be employed. First, parts of the spark plug 100 that include the insulator 10, the metal terminal 40, material powder of the resistor 73, material powder of the seal portions 72 and 74, the metal shell 50, the center electrode 20, and a linear ground electrode 30 are prepared. The insulator 10 is produced by, for example, molding material powder of alumina or the like into a predetermined shape and baking the molded member. Metal members such as the metal terminal 40, the metal shell 50, the center electrode 20, and the linear ground electrode 30 are produced by a method such as forging, cutting, or welding, for example.

Next, with use of the prepared members, an assembly including the insulator 10, the center electrode 20, and the metal terminal 40 is prepared. For example, the center electrode 20 is inserted from an opening on the rearward direction Dfr side of the insulator 10. The center electrode 20 is supported by the inner diameter reduction portion 11 of the insulator 10, to be located at a predetermined position in the through hole 12. Next, putting-in of material powders of the first seal portion 72, the resistor 73, and the second seal portion 74, and molding of the material powders having been put in, are performed in the order of the members 72, 73, and 74. The powder materials are put into the through hole 12 from the opening on the rearward direction Dfr side of the insulator 10. Next, the insulator 10 is heated to a predetermined temperature higher than the softening points of glass components contained in the material powders of the members 72, 73, and 74, and, in a state where the insulator 10 is heated to the predetermined temperature, the axial portion 41 of the metal terminal 40 is inserted in the through hole 12 from the opening on the rearward direction Dfr side of the insulator 10. As a result, the material powders of the members 72, 73, and 74 are compressed and sintered, thereby forming the members 72, 73, and 74. Accordingly, the metal terminal 40 is fixed to the insulator 10.

Figure 2:
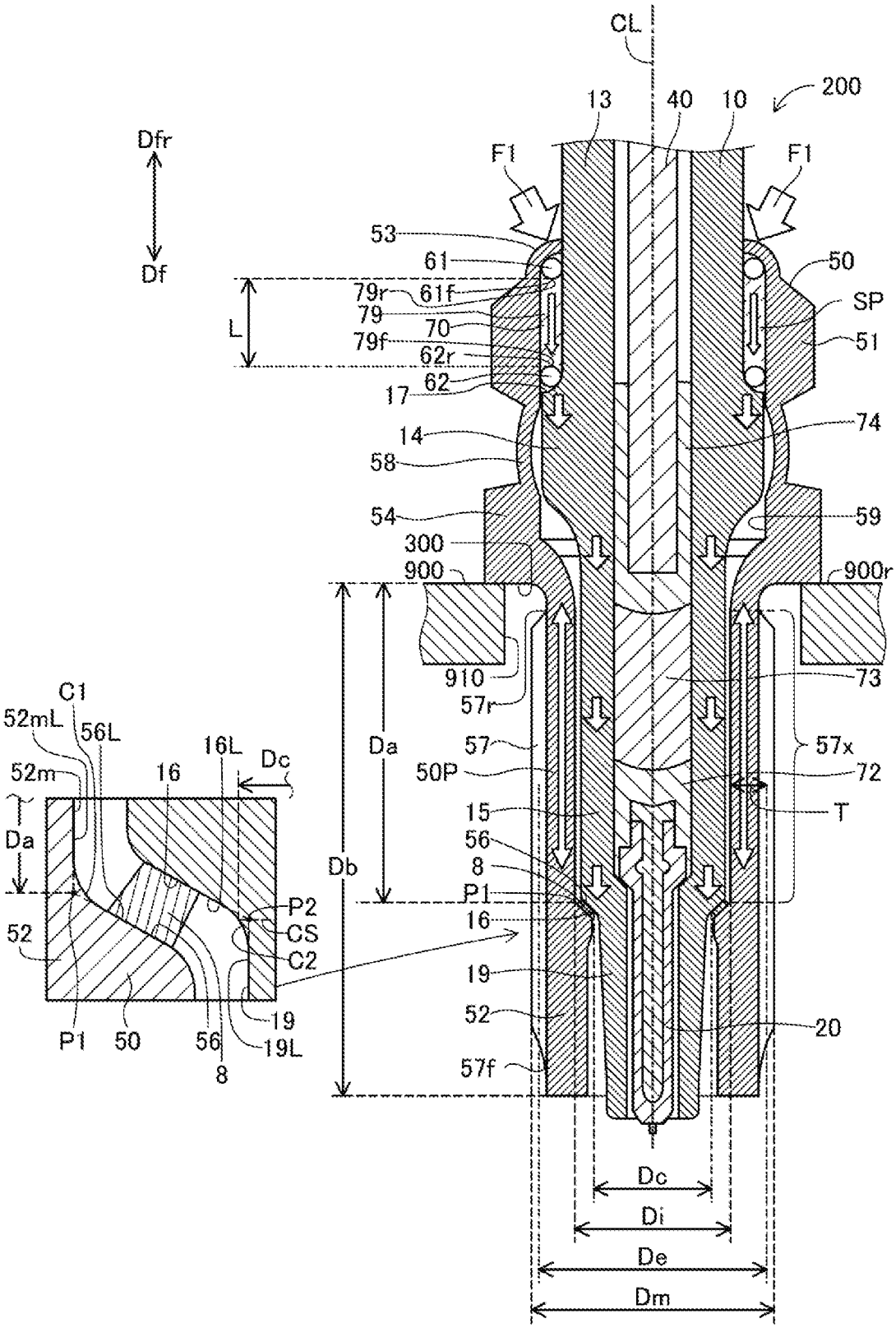
FIG. 2 is a schematic view showing a manner in which an assembly 200 is fixed to a metal shell 50.

Next, the above-described assembly including the insulator 10 is fixed to the metal shell 50. FIG. 2 is a schematic view showing a manner in which an assembly 200 is fixed to the metal shell 50. In the drawing, a cross section of the assembly 200 including the insulator 10 and of the metal shell 50 is shown. The central axis CL and the directions Df and Dfr in the drawing indicate a central axis CL and directions Df and Dfr, as viewed along the insulator 10 and the metal shell 50 of the completed spark plug 100 (FIG. 1). The cross section in FIG. 2 is a flat cross section including the axial line CL. Hereinafter, positional relationships are described with use of the axial line CL and the directions Df and Dfr.

In the embodiment in FIG. 2, a support tool 900 for supporting the metal shell 50 is used. The support tool 900 is a plate-like member having a through hole 910 formed therein. The inner diameter of the through hole 910 is larger than the outer diameter of the screw portion 57 of the metal shell 50, and smaller than the outer diameter of the seating surface 300 of the middle trunk portion 54. The front-side trunk portion 52 of the metal shell 50 is inserted in the through hole 910 of the support tool 900. A surface 900*r* on the rearward direction Dfr side of the support tool 900 comes into contact with the seating surface 300 of the middle trunk portion 54 of the metal shell 50 so as to support the metal shell 50. Accordingly, the middle trunk portion 54 of the metal shell 50 is supported by the support tool 900, and thus cannot be moved in the frontward direction Df.

In this state, the front-side packing 8, the assembly 200, the ring member 62, the talc 70, and the ring member 61 are disposed in the through hole 59 of the metal shell 50. Specifically, the packing 8 is disposed on the inner diameter reduction portion 56 of the metal shell 50. The assembly 200 is disposed at such a position that the outer diameter reduction portion 16 of the insulator 10 comes into contact with the packing 8. On the rearward direction Dfr side relative to the outer diameter reduction portion 17 of the insulator 10, a space SP is formed between the inner peripheral surface of the metal shell 50 and the outer peripheral surface of the rear-side trunk portion 13 of the insulator 10. Before being crimped, the rear end portion 53 of the metal shell 50 extends in the rearward direction Dfr although such a state is not shown. The ring member 62, the talc 70, and the ring member 61 are disposed in the space SP. Specifically, the ring member 62 is disposed on the outer diameter reduction portion 17. The talc 70 is filled on the rearward direction Dfr side relative to the ring member 62. The ring member 61 is disposed on the rearward direction Dfr side relative to the talc 70. Then, force F1 toward the frontward direction Df side is applied to the rear end portion 53 of the metal shell 50. This force is transmitted to the buckling portion 58 so as to deform the buckling portion 58 such that the length thereof in a direction parallel to the axial line CL is reduced (e.g., the buckling portion 58 is deformed to the outer peripheral side). In addition, with the force F1, the rear end portion 53 is crimped to be bent inward. The talc 70 is compressed between the ring member 61 and the ring member 62.

The force F1 applied to the rear end portion 53 of the metal shell 50 is transmitted to also the outer diameter reduction portion 17 of the insulator 10 via the ring member 61, the talc 70, and the ring member 62. Accordingly, the insulator 10 is pressed relatively in the frontward direction Df against the metal shell 50. Accordingly, the outer diameter reduction portion 16 of the insulator 10 is pressed toward the inner diameter reduction portion 56 of the metal shell 50. That is, the packing 8 is pressed between the outer diameter reduction portion 16 and the inner diameter reduction portion 56. Accordingly, the insulator 10 is fixed to the metal shell 50.

In addition, the rod-like ground electrode 30 is joined (e.g., by resistance welding) to the front end surface 55 of the metal shell 50 although such a state is not shown. Then, the distance of the gap g is adjusted by bending the rod-like ground electrode 30. Through the above-mentioned process, the spark plug 100 is completed. It is noted that the ground electrode 30 may be joined to the metal shell 50 before the assembly 200 is fixed to the metal shell 50.

A-3. Parameters of Spark Plug 100:

As described above, when the rear end portion 53 of the metal shell 50 (FIG. 2) is crimped, the inner diameter reduction portion 56 of the metal shell 50 receives load in the frontward direction Df from the outer diameter reduction portion 16 of the insulator 10 via the packing 8. Meanwhile, the middle trunk portion 54 of the metal shell 50 is supported by the support tool 900, and thus cannot be moved in the frontward direction Df. As a result of these features, by the rear end portion 53 being crimped, an intermediate portion 50P which is a portion, of the metal shell 50, between the seating surface 300 of the middle trunk portion 54 and the inner diameter reduction portion 56 can be deformed so as to extend along the axial line CL. When the intermediate portion 50P is deformed, a rear portion 57*x* which is a portion, of the screw portion 57, provided on the intermediate portion 50P can be deformed. In order to appropriately mount the spark plug 100 into the mounting hole of the internal combustion engine, it is preferable to suppress deformation of the screw portion 57, and further, deformation of the intermediate portion 50P.

Hereinafter, a configuration, of the spark plug 100, for suppressing deformation of the intermediate portion 50P is discussed. In FIG. 2, parameters L, T, Di, De, Da, Db, Dm, and Dc of the spark plug 100 are indicated. Hereinafter, these parameters and characteristics of the spark plug 100 will be described.

A filling length L is a length, in the direction parallel to the axial line CL, of a filled portion 79 filled with the talc 70. As described above, in the present embodiment, the talc 70 is filled at a portion, of the space SP, between the ring member 61 and the ring member 62. The outer surface of the ring member 61 and the outer surface of the ring member 62 are curved surfaces, and thus the length, in the direction parallel to the axial line CL, of the filled portion 79 changes in accordance with the position thereof in the direction perpendicular to the axial line CL. In such a case, a distance as described below is used as the filling length L. That is, the filling length L is a distance in the direction parallel to the axial line CL between: a position 79*f*, closest to the rearward direction Dfr side, on a surface that is present on the frontward direction Df side of the filled portion 79; and a position 79*r*, closest to the frontward direction Df side, on a surface that is present on the rearward direction Dfr side of the filled portion 79. In the present embodiment, the position 79*f* on the frontward direction Df side is the same as the position of a rear end 62*r* of the ring member 62, and the position 79*r* on the rearward direction Dfr side is the same as the position of a front end 61*f* of the ring member 61. The filling length L is the length of the filled portion 79, in the completed spark plug 100 (i.e., the length of the filled portion 79 after the rear end portion 53 is crimped).

In a case where the filling length L is large, the amount of the talc 70 to be compressed when the rear end portion 53 is crimped is large. Therefore, in the case where the filling length L is large, when the rear end portion 53 is crimped, the talc 70 can absorb force by being compressed, and thus the force to be applied to the inner diameter reduction portion 56 of the metal shell 50 via the insulator 10 and the packing 8 can be inhibited from becoming excessive. As a result, deformation of the intermediate portion 50P of the metal shell 50 is suppressed. In addition, the compressed talc 70 can apply load on the packing 8, in the completed spark plug 100. By increasing the filling length L, this load can be increased. As a result, the airtightness provided by the packing 8 can be improved. Furthermore, in the case where the filling length L is large, the talc 70 can apply appropriate load on the packing 8, and thus the force for crimping the rear end portion 53 can be reduced. As a result, deformation of the intermediate portion 50P of the metal shell 50 can be suppressed.

A minimum thickness T (FIG. 2) is a minimum value of an effective thickness of the rear portion 57*x*, of the screw portion 57 of the metal shell 50, which is present on the rearward direction Dfr side relative to the inner diameter reduction portion 56. Here, the effective thickness means a thickness that is half the difference left after subtraction of an inner diameter Di of the metal shell 50 from a pitch diameter De of the screw portion 57. The pitch diameter De of the screw portion 57 is a pitch diameter of an external thread of the screw portion 57, and is the diameter of such an imaginary cylinder that the width of a thread groove thereof becomes equal to the width of a thread ridge thereof. In the present embodiment, the pitch diameter De is constant at any position in the direction parallel to the axial line CL. The inner diameter Di of the metal shell 50 can change in accordance with the position thereof in the direction parallel to the axial line CL. Therefore, the effective thickness can change in accordance with the position in the direction parallel to the axial line CL. The minimum thickness T is the minimum value of the variable effective thickness of the rear portion 57*x* of the screw portion 57. The pitch diameter De may change in accordance with the position in the direction parallel to the axial line CL.

A portion, of the intermediate portion 50P deformable upon the crimping, on which the screw portion 57 is formed becomes less likely to be deformed as the above-described minimum thickness T is increased. Therefore, the minimum thickness T is preferably made large in order to suppress deformation of the screw portion 57 on the intermediate portion 50P.

A length Da in FIG. 2 is a length, in the direction parallel to the axial line CL, of the intermediate portion 50P (referred to also as an intermediate-portion length Da). The position (here, position in the direction parallel to the axial line CL) of an end on the rearward direction Dfr side of the intermediate portion 50P is the same as the position of a portion supported so as not to move in the frontward direction Df upon the crimping (here, seating surface 300). The position (position in the direction parallel to the axial line CL) of an end on the frontward direction Df side of the intermediate portion 50P is the same as the position of an end on the rearward direction Dfr side of the inner diameter reduction portion 56.

On the left side of FIG. 2, a partial cross section in which the position of the end on the frontward direction Df side of the intermediate portion 50P is indicated is shown. The partial cross section is an enlarged view of a portion, of the cross section in FIG. 2, that includes the inner diameter reduction portion 56 of the metal shell 50, the outer diameter reduction portion 16 of the insulator 10, and the packing 8.

A rear portion 52*m* in the view is a portion, of the front-side trunk portion 52 of the metal shell 50, that is connected to the rearward direction Dfr side of the inner diameter reduction portion 56. As shown therein, a connection portion C1 between the inner peripheral surface of the inner diameter reduction portion 56 and the inner peripheral surface of the rear portion 52*m* can be rounded. In this case, a boundary between the inner diameter reduction portion 56 and the rear portion 52*m* may be specified as follows. In the cross section in the view, an intersection point P1 of two straight lines may be used as the position of the boundary, the two straight lines being obtained by respectively extending: a portion 56L, closest to the rear portion 52*m*, of a linear portion indicating the inner peripheral surface of the inner diameter reduction portion 56; and a portion 52*m*L, closest to the inner diameter reduction portion 56, of a linear portion indicating the inner peripheral surface of the rear portion 52*m*. The intersection point P1 may be used as the position of the end on the frontward direction Df side of the intermediate portion 50P. The distance in the direction parallel to the axial line CL between the intersection point P1 and the position of the end on the rearward direction Dfr side of the intermediate portion 50P (here, the position of the seating surface 300) may be used as the length Da of the intermediate portion 50P.

A length Db in FIG. 2 is a length in the direction parallel to the axial line CL between the seating surface 300 and the front end (here, front end surface 55) of the metal shell 50 (referred to also as a screw length Db). The metal terminal 40 (FIG. 1) can be made distant from the gap g by increasing the screw length Db, whereby the degree of freedom in designing of the internal combustion engine can be improved. However, in the case where the screw length Db is large, the intermediate portion 50P deformable upon the crimping is also elongated. When the long intermediate portion 50P is deformed, also the long rear portion 57*x*, of the screw portion 57, provided on the intermediate portion 50P can be deformed. The spark plug 100 is preferably configured such that deformation of the intermediate portion 50P is suppressed, in order to increase the screw length Db.

In addition, the intermediate portion 50P is not necessarily deformed so as to extend parallelly to the axial line CL, but also can be deformed so as to be bent. Here, in the case where the screw length Db is large, the distance between a bent portion of the intermediate portion 50P and the front end (here, front end surface 55) of the metal shell 50 can be increased. In the case where this distance is long, the position of the front end of the metal shell 50 can be greatly displaced in the direction perpendicular to the axial line CL. In the case where the position of the front end of the metal shell 50 is displaced in the direction perpendicular to the axial line CL, it can become difficult to appropriately mount the spark plug 100 into the mounting hole of the internal combustion engine. Also from this standpoint, the spark plug 100 is preferably configured such that deformation of the intermediate portion 50P is suppressed, in order to increase the screw length Db.

Furthermore, the temperature of the spark plug 100 is increased owing to reception of heat from combustion gas when the internal combustion engine is driven. A metallic member such as the metal shell 50 expands owing to increase in the temperature. For example, the metal shell 50 extends in the direction parallel to the axial line CL owing to the increase in the temperature. Accordingly, the inner diameter reduction portion 56 of the metal shell 50 can move in the frontward direction Df relative to the insulator 10. As a result, the load being applied to the packing 8 can be lessened, and the airtightness provided by the packing 8 can be reduced. The amount of extension of the metal shell 50 due to the increase in the temperature increases as the screw length Db becomes larger. Therefore, in the case where the screw length Db is large, the airtightness provided by the packing 8 is easily reduced. Here, in a case where deformation of the intermediate portion 50P upon the crimping is slight, the talc 70 can apply great load on the packing 8 after the spark plug 100 is completed. Therefore, even when the metal shell 50 extends owing to the increase in the temperature, the load being applied to the packing 8 can be inhibited from becoming insufficient. Accordingly, reduction in the airtightness provided by the packing 8 can be suppressed. Also from this standpoint, the spark plug 100 is preferably configured such that deformation of the intermediate portion 50P is suppressed, in order to increase the screw length Db.

A nominal diameter Dm in FIG. 2 is the nominal diameter of the screw portion 57. By reducing the nominal diameter Dm, the mounting hole of the internal combustion engine can be narrowed, and thus the degree of freedom in designing of the internal combustion engine can be improved. If the outer diameter of the insulator 10 on the inner peripheral side of the front-side trunk portion 52 of the metal shell 50 is reduced to reduce the nominal diameter Dm, the thickness of the insulator 10 becomes small, and thus electric discharge comes to easily occur between the center electrode 20 and the metal shell 50 so as to penetrate the insulator 10. If the thickness of the front-side trunk portion 52 is made small, the nominal diameter Dm can be reduced while unintended electric discharge is inhibited. However, in the case where the thickness of the front-side trunk portion 52 is small, the intermediate portion 50P of the front-side trunk portion 52 is easily deformed. Thus, the spark plug 100 is preferably configured such that deformation of the intermediate portion 50P is suppressed, in order to reduce the nominal diameter Dm.

An outer diameter Dc in FIG. 2 is the outer diameter, of the leg portion 19 of the insulator 10, at an end on the rearward direction Dfr side (referred to also as a base diameter Dc). A position P2 on the partial cross section on the left side of FIG. 2 indicates the position of the end on the rearward direction Dfr side of the leg portion 19. As shown therein, a connection portion C2 between the outer peripheral surface of the leg portion 19 and the outer peripheral surface of the outer diameter reduction portion 16 can be rounded. In this case, a boundary between the leg portion 19 and the outer diameter reduction portion 16 may be specified as follows. In the cross section in the view, an intersection point P2 of two straight lines may be used as the position of the boundary, the two straight lines being obtained by respectively extending: a portion 19L, closest to the outer diameter reduction portion 16, of a linear portion indicating the outer peripheral surface of the leg portion 19; and a portion 16L, closest to the leg portion 19, of a linear portion indicating the outer peripheral surface of the outer diameter reduction portion 16. The intersection point P2 may be used as the position of the end on the rearward direction Dfr side of the leg portion 19. The outer diameter of the insulator 10 at a cross section CS that is perpendicular to the axial line CL and that includes the intersection point P2 may be used as the base diameter Dc of the leg portion 19 of the insulator 10.

The intermediate portion 50P of the metal shell 50 can be deformed so as to be diagonally tilted with respect to the axial line CL (e.g., the intermediate portion 50P can be bent). In this case, the inner diameter reduction portion 56 of the metal shell 50 can apply, to the outer diameter reduction portion 16 of the insulator 10, force for diagonally tilting the insulator 10 with respect to the axial line CL. Owing to such force, the base of the leg portion 19 of the insulator 10 can be cracked. In particular, in a case where the nominal diameter Dm is small, also the base diameter Dc of the leg portion 19 is small, and thus the base of the leg portion 19 is easily cracked. The spark plug 100 is preferably configured such that deformation of the intermediate portion 50P is suppressed, in order to reduce the base diameter Dc.

Figure 3:
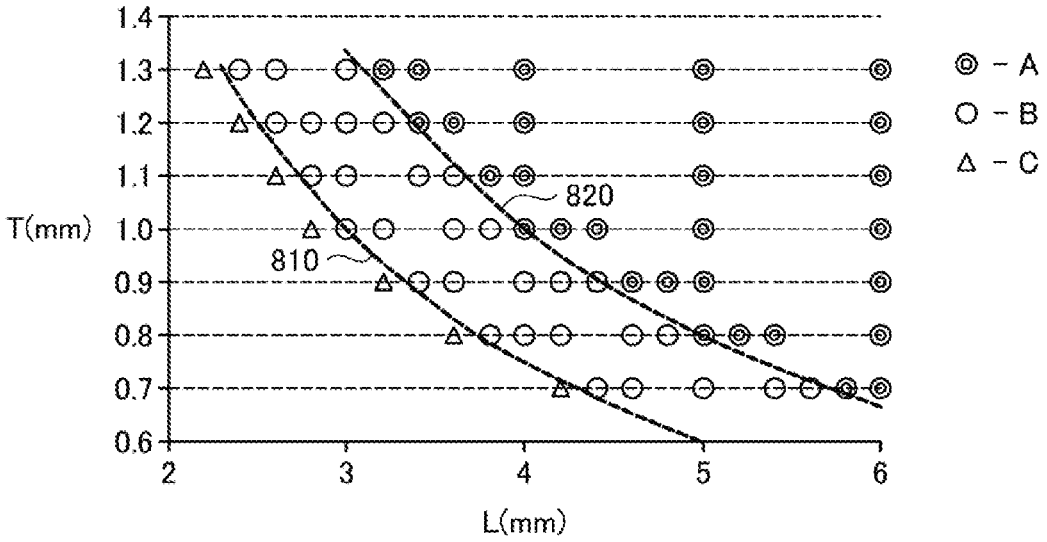
FIG. 3 is a graph showing test results.

A-4. First Evaluation Test:

With the above-described observations being taken into consideration, multiple kinds of samples of the spark plug 100 were prepared, and an evaluation test regarding deformation of the screw portion 57 was performed. FIG. 3 is a graph indicating the results of the test. The horizontal axis indicates filling length L (the unit thereof is mm), and the vertical axis indicates the minimum thickness T (the unit thereof is mm). For the evaluation test, multiple kinds of samples of the spark plug 100 were prepared such that the samples were different from one another in terms of at least one of the filling length L and the minimum thickness T. As the filling length L, various values within a range of not smaller than 2.2 mm and not larger than 6.0 mm were used. As the minimum thickness T, various values within a range of not smaller than 0.7 mm and not larger than 1.3 mm were used. Dimensions that were common among the samples are as follows.

Intermediate-portion length Da=18 mm

Screw length Db=25 mm

Nominal diameter Dm=M8

Pitch diameter De=7.4 mm

Base diameter Dc=4 mm

The configuration (e.g., nominal diameter Dm) of the external thread of the screw portion 57 was the same among the multiple kinds of samples.

Two types of ring gauges to be fitted to the screw portion 57 of the metal shell 50 were prepared in the evaluation test. A first type ring gauge is a go ring gauge defined in JIS B 0251, and is a ring-shaped gauge (also called a limit gauge) in which an internal thread corresponding to the screw portion 57 of the metal shell 50 is formed. A second type ring gauge is a go ring gauge in which an internal thread larger than that of the first type ring gauge is formed. Specifically, the second type ring gauge was manufactured such that the pitch diameter of the internal thread thereof becomes a value obtained by adding, to a basic dimension defined in JIS B 0251, a value that is three times an upper limit deviation thereof. For example, the pitch diameter of an M8×0.75-6g GR gauge is 7.489±0.007 (mm). The target value for the pitch diameter of the second type ring gauge corresponding to this first type ring gauge is 7.489+3×0.007=7.510 (mm). In order to easily and appropriately mount a spark plug, an internal thread of a mounting hole of a general internal combustion engine has a pitch diameter that is slightly larger than a pitch diameter corresponding to a ring gauge defined in JIS B 0251. That is, a mounting hole of a general internal combustion engine is formed such that a spark plug having an external thread that is slightly larger than an external thread corresponding to a ring gauge of JIS B 0251 can be appropriately mounted thereinto. The above-described pitch diameter of the second type ring gauge is an example of the pitch diameter of such a mounting hole of an internal combustion engine.

In the graph in FIG. 3, marks, i.e., "double circles", "single circles", and "triangles" are shown. Each mark indicates an evaluation result of one combination of a filling length L and a minimum thickness T (i.e., one kind of sample). In the evaluation test, the screw portion 57 of the metal shell 50 of each sample of the spark plug 100 (FIG. 1) was screwed into the ring gauges. Then, the ring gauges were rotated relative to the metal shell 50 so as to be moved from a front end 57*f* which is an end on the frontward direction Df side of the screw portion 57 to a rear end 57*r* which is an end on the rearward direction Dfr side of the screw portion 57 and moved to the front end 57*f* of the screw portion 57 again. If the screw portion 57 on the intermediate portion 50P is greatly deformed as a result of the rear end portion 53 of the metal shell 50 being crimped, the ring gauges cannot be moved to the rear end 57*r* of the screw portion 57. Evaluation A represented by the "double circle" indicates that the first type ring gauge was able to be moved over the entire length from the front end 57*f* of the screw portion 57 to the rear end 57*r* thereof. Evaluation B represented by the "single circle" indicates that, although the first type ring gauge was not able to be moved to the rear end 57*r* of the screw portion 57, the second type ring gauge was able to be moved over the entire length of the screw portion 57. Evaluation C represented by the "triangle" indicates that the second type ring gauge was not able to be moved to the rear end 57*r* of the screw portion 57. Samples of the spark plug 100 rated evaluation A (double circle) and evaluation B (single circle) can be appropriately mounted into a mounting hole of a general internal combustion engine.

As shown in the graph, in a case where the minimum thickness T is constant, the evaluation results were more satisfactory as the filling length L was larger. It is assumed that this is because, as the filling length L is larger, absorption of force performed by the talc 70 is more facilitated, and thus deformation of the intermediate portion 50P of the metal shell 50 is more suppressed, as described above.

In addition, as shown in the graph, in a case where the filling length L is constant, the evaluation results were more satisfactory as the minimum thickness T was larger. It is assumed that this is because the intermediate portion 50P of the metal shell 50 is less likely to be deformed as the minimum thickness T is larger, as described above.

Furthermore, in the graph, two boundary lines 810 and 820 are shown. The first boundary line 810 indicates a line represented by $T \times L = 3\ mm^2$, and the second boundary line 820 indicates a line represented by $T \times L = 4\ mm^2$. As shown therein, in a case where T×L is equal to or greater than 3 $mm^2$ (i.e., in a case where a mark indicating a combination of T and L is present in a region from the first boundary line 810 to the upper right side), the evaluation result is evaluation B or higher. Thus, in the case where "$3\ mm^2 \leq L \times T$" was satisfied, deformation of the screw portion 57 was appropriately suppressed.

In a case where T×L is equal to or greater than 4 $mm^2$ (i.e., in a case where a mark indicating a combination of T and L is present in a region from the second boundary line 820 to the upper right side), the evaluation result is evaluation A. Thus, in the case where "$4\ mm^2 \leq L \times T$" was satisfied, deformation of the screw portion 57 was further suppressed.

As shown in the graph, the various samples with the minimum thickness T being not larger than 1.3 mm were rated evaluation A or evaluation B. Thus, even in the case where the minimum thickness T was not larger than 1.3 mm, deformation of the screw portion 57 was suppressed through adjustment of the minimum thickness T and the filling length L.

As described above, it is possible to suppress deformation of the intermediate portion 50P (and further, the screw portion 57) through adjustment of the minimum thickness T and the filling length L. In the case where deformation of the intermediate portion 50P is thus suppressed, a spark plug 100 that is thin and long as per the samples in the above-described evaluation test, can be used. Specifically, the screw length Db may be as large as 25 mm, the intermediate-portion length Da may be as large as 18 mm, the nominal diameter Dm may be as small as M8, and the base diameter Dc may be as small as 4 mm. Even in the case where such thin and long spark plug 100 is used, deformation of the intermediate portion 50P is suppressed, whereby malfunctions due to deformation of the intermediate portion 50P can be suppressed.

Figure 4:
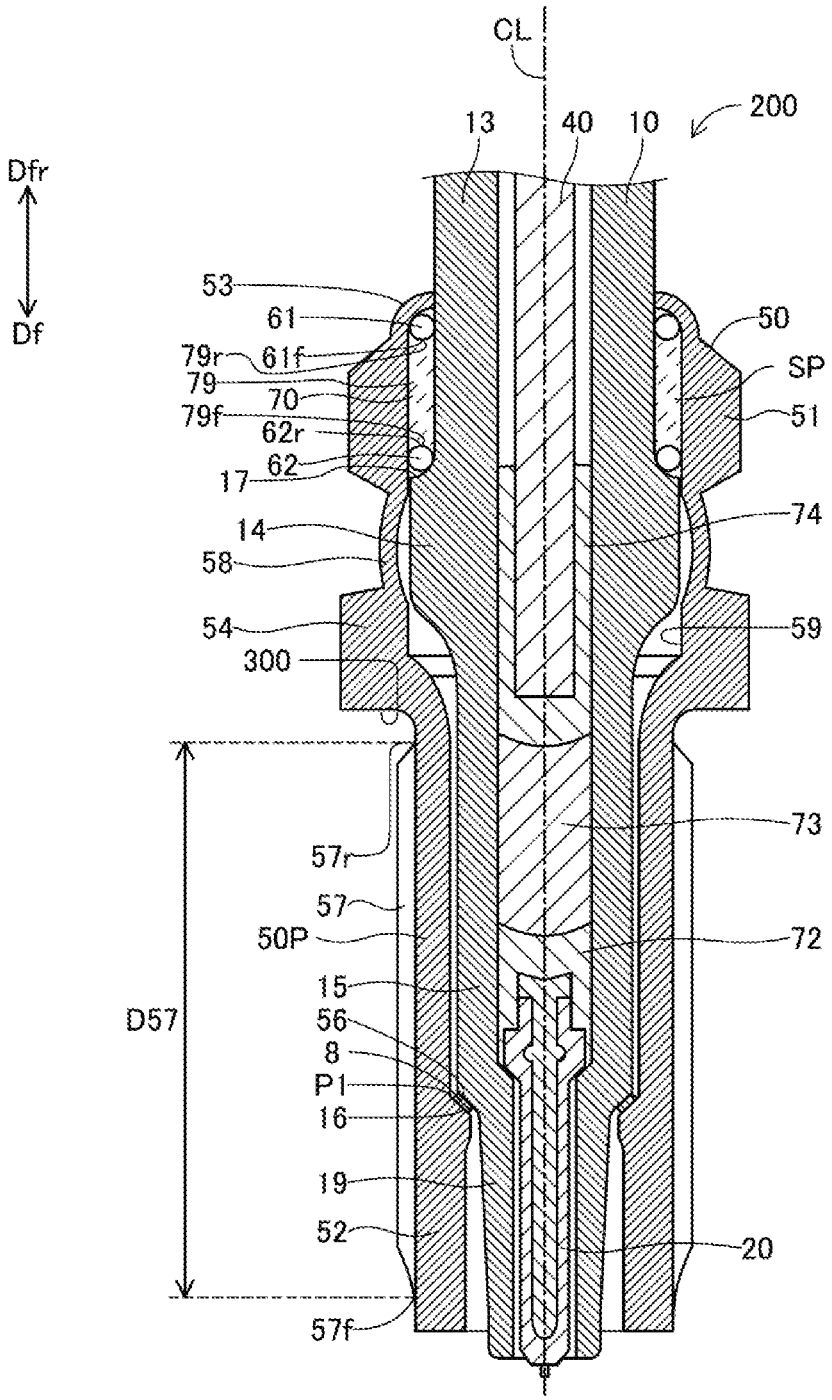
FIG. 4 is a view for explaining the length of a screw portion 57.

A-5. Second Evaluation Test:

Another evaluation test using multiple kinds of samples of the spark plug 100 and the results thereof will be described. In this evaluation test, evaluations were performed in relation to the length of the screw portion 57. FIG. 4 is a view for explaining the length of the screw portion 57. In the drawing, a cross section of the assembly 200 and the metal shell 50 is shown as in FIG. 2. A length D57 of the screw portion 57 is a length in the direction parallel to the axial line CL from the front end 57*f* of the screw portion 57 to the rear end 57*r* thereof. The front end 57*f* of the screw portion 57 is an end on the frontward direction Df side of the external thread of the screw portion 57, and is an end on the frontward direction Df side of a portion along which a thread ridge and a thread groove are formed. The rear end 57*r* of the screw portion 57 is an end on the rearward direction Dfr side of the external thread of the screw portion 57, and is an end on the rearward direction Dfr side of the portion along which the thread ridge and the thread groove are formed.

FIG. 5(A) and FIG. 5(B) are tables indicating the correspondence relationship between the configurations of samples of the spark plug 100 and the test results. These tables each indicate the correspondence relationship among the length D57 (the unit thereof is mm), an evaluation result Rc, and the number Nc of defective samples. In this evaluation test, the second type ring gauge was screwed onto the screw portion 57 of the metal shell 50 as in the evaluation test in FIG. 3. Then, the second type ring gauge was rotated relative to the metal shell 50 so as to be moved from the front end 57*f* of the screw portion 57 to the rear end 57*r* thereof and moved to the front end 57*f* of the screw portion 57 again. The test in which the second type ring gauge was moved, was performed on each of 10 samples having the same configuration. The number Nc of defective samples is the total number of samples, among the 10 samples, in each of which the ring gauge was not able to be moved to the rear end 57*r* of the screw portion 57. Evaluation results Rc that are evaluation A indicate that the number Nc of defective samples is zero, and evaluation results Rc that are evaluation B indicate that the number Nc of defective samples is one or more.

In the evaluation test of FIG. 5(A), six kinds of samples different from one another in terms of the length D57 were evaluated. In each of the six kinds of samples, combinations of the minimum thicknesses T and the filling lengths L are located on the left side relative to the first boundary line 810 in the graph in FIG. 3, and specifically, the minimum thickness T is 1.1 mm, the filling length L is 2 mm, and T×L is 2.2 $mm^2$. Hereinafter, the samples used in the evaluation test of FIG. 5(A) are referred to also as first type samples or reference examples.

In the evaluation test of FIG. 5(B), nine kinds of samples different from one another in terms of the length D57 were evaluated. In each of the nine kinds of samples, combinations of the minimum thicknesses T and the filling lengths L are located on the right side relative to the first boundary line 810 in the graph in FIG. 3, and specifically, the minimum thickness T is 1.1 mm, the filling length L is 3 mm, and T×L is 3.3 $mm^2$. Hereinafter, the samples used in the evaluation test of FIG. 5(B) are referred to also as second type samples.

The first type samples in FIG. 5(A) and the second type samples in FIG. 5(B) are different from each other in terms of the filling length L. In addition, in accordance with adjustment of the length D57 of the screw portion 57, the screw length Db (FIG. 2) was also adjusted (such that the larger the length D57 is, the larger the screw length Db becomes). Configurations other than those of these portions were common between the samples in FIG. 5(A) and the samples in FIG. 5(B). For example, the following dimensions were common therebetween.

Intermediate-portion length Da=18 mm
Nominal diameter Dm=M8
Pitch diameter De=7.4 mm
Base diameter Dc=4 mm The lengths D57 in the six types of samples in FIG. 5(A) were 11, 13, 15, 17, 19, and 21 (mm), respectively. The evaluation result Rc was evaluation A in a case where the length D57 was not larger than 13 mm, and the evaluation result Rc was evaluation B in a case where the length D57 was not smaller than 15 mm. The reason why the evaluation result Rc became low in the case where the length D57 was large, is as follows.

When a portion of the screw portion 57 (e.g., intermediate portion 50P) is deformed, the screw portion 57 can be bent at the deformed portion. As described above, in the case where the length D57 of the screw portion 57 is large, the distance between the bent portion of the intermediate portion 50P and the front end (here, front end surface 55) of the metal shell 50 can be increased. In the case where this distance is long, the position of the front end of the metal shell 50 can be greatly displaced in the direction perpendicular to the axial line CL. In the case where the positional displacement is large, the internal thread of the ring gauge, a mounting hole of an internal combustion engine, or the like can become difficult to be screwed from the front end 57*f* of the screw portion 57 of the metal shell 50 to the rear end 57*r* thereof.

The lengths D57 of the nine kinds of samples in FIG. 5(B) were 11, 13, 15, 17, 19, 21, 23, 25, and 27 (mm), respectively. The evaluation results Rc of all of the samples were evaluation A. Thus, in the case where T×L (=3.3 $mm^2$) is equal to or greater than 3 $mm^2$, the second type ring gauge was able to be moved over the entire length of the screw portion 57 from the front end 57*f* to the rear end 57*r* even if the length D57 is not smaller than 15 mm. This is because deformation of the intermediate portion 50P (and further, screw portion 57) is suppressed through adjustment of the minimum thickness T and the filling length L, as described regarding the test results in FIG. 3.

As described in FIG. 3, in the case where T×L is equal to or greater than 3 $mm^2$, deformation of the intermediate portion 50P (and further, screw portion 57) is suppressed with the combinations of various minimum thicknesses T and various filling lengths L. Therefore, it is possible to increase the length D57 of the screw portion 57 of each of spark plugs 100 having various minimum thicknesses T and various filling lengths L, the combinations of which are not limited to the combination of the minimum thickness T and the filling length L in each sample in FIG. 5(B). The length D57 may be a value within various ranges each including at least a part of a range of not smaller than 11 mm and not larger than 27 mm which is a distribution range of the nine lengths D57 in FIG. 5(B) with which evaluation A was achieved. For example, the length D57 may be not smaller than 11 mm, or not smaller than 15 mm. In addition, the upper limit of the length D57 may be determined with use of the nine lengths D57 with which evaluation A was achieved in the test results in FIG. 5(B). Specifically, an arbitrary value among the nine values may be used as the upper limit of a preferable range of the length D57. For example, the length D57 may be not larger than 27 mm. In the case where T×L is equal to or greater than 3 $mm^2$, deformation of the screw portion 57 is suppressed, and thus it is assumed that the length D57 may exceed 27 mm.

B. Modifications (1) The values of the minimum thickness T and the filling length L (FIG. 2) are not limited to the values in the samples used in the evaluation test of FIG. 3, but may be any values. Generally, deformation of the intermediate portion 50P is more suppressed as the filling length L is increased. Therefore, the filling length L is preferably large regardless of the minimum thickness T, and may be larger than 6.0 mm, for example. In the case where the minimum thickness T is large (e.g., in the case where the minimum thickness T is larger than 1.3 mm), the filling length L may be smaller than 2.2 mm. In the evaluation test of FIG. 3, an arbitrary value within a range of not smaller than 2.2 mm and not larger than 6.0 mm which is a distribution range of the filling lengths L in the multiple kinds of samples with which evaluation results of evaluation B or higher were achieved, may be used as the filling length L. In addition, generally, deformation of the intermediate portion 50P is more suppressed as the minimum thickness T is increased. Therefore, the minimum thickness T is preferably large regardless of the filling length L, and may be larger than 1.3 mm, for example. In the case where the filling length L is large (e.g., in the case where the filling length L is larger than 6.0 mm), the minimum thickness T may be smaller than 0.7 mm. In the evaluation test of FIG. 3, an arbitrary value within a range of not smaller than 0.7 mm and not larger than 1.3 mm which is a distribution range of the minimum thicknesses T in the multiple kinds of samples with which evaluation results of evaluation B or higher were achieved, may be used as the minimum thickness T. In either case, "3 $mm^2 \leq L \times T$" is preferably satisfied, and "4 $mm^2 \leq L \times T$" is particularly preferably satisfied.

(2) The values of the various parameters in the spark plug 100 described in FIG. 2 are not limited to the values in the samples used in the evaluation test of FIG. 3, but may be any values. For example, the screw length Db may be smaller than 25 mm which is the screw length Db of each sample in FIG. 3. In addition, the screw length Db may be larger than 25 mm. It is assumed that, also in this case, deformation of the intermediate portion 50P can be suppressed by increasing L×T (e.g., 4 $mm^2 \leq L \times T$). Thus, since deformation of the intermediate portion 50P can be suppressed, the screw length Db can be increased. For example, a screw length Db not smaller than 25 mm is preferable in that the degree of freedom in designing of an internal combustion engine can be improved.

The intermediate-portion length Da may be smaller than 18 mm which is the intermediate-portion length Da of each sample in FIG. 3. In addition, the intermediate-portion length Da may be larger than 18 mm. It is assumed that, also in this case, deformation of the intermediate portion 50P can be suppressed by increasing L×T (e.g., 4 $mm^2 \leq L \times T$). Thus, since deformation of the intermediate portion 50P can be suppressed, the intermediate-portion length Da can be increased. For example, an intermediate-portion length Da not smaller than 18 mm is preferable in that the degree of freedom in designing of an internal combustion engine can be improved.

The nominal diameter Dm may be greater than M8 which is the nominal diameter Dm of each sample in FIG. 3 (e.g., M10 or M12). In addition, the nominal diameter Dm may be less than M8 (e.g., M6). It is assumed that, also in this case, deformation of the intermediate portion 50P can be suppressed by increasing L×T (e.g., 4 $mm^2 \leq L \times T$).

The base diameter Dc may be larger than 4 mm which is the base diameter Dc of each sample in FIG. 3. In addition, the base diameter Dc may be smaller than 4 mm. It is assumed that, also in this case, deformation of the intermediate portion 50P can be suppressed by increasing L×T (e.g., 4 $mm^2 \leq L \times T$). Thus, since deformation of the intermediate portion 50P can be suppressed, the base diameter Dc can be reduced. For example, a base diameter Dc not larger than 4 mm is preferable in that the degree of freedom in designing of the spark plug 100 can be improved.

The length D57 of the screw portion 57 described in FIG. 4 may be any value larger than zero. As described above, it is assumed that deformation of the intermediate portion 50P can be suppressed by increasing L×T (e.g., 4 $mm^2 \leq L \times T$). Thus, since deformation of the intermediate portion 50P can be suppressed, the length D57 can be increased. For example, a length D57 not smaller than 15 mm is preferable in that the degree of freedom in designing of an internal combustion engine can be improved. In addition, the length D57 may exceed 27 mm which is the maximum value among the lengths D57 of the samples in FIG. 5(B).

(3) As the configuration of a spark plug, various other configurations may be employed instead of the configurations of the above-described embodiments. For example, the front-side packing 8 (FIG. 1) may be omitted. In this case, an inner diameter reduction portion (e.g., inner diameter reduction portion 56 in FIG. 2(A)) of a metal shell comes into contact with an outer diameter reduction portion (e.g., outer diameter reduction portion 16 in FIG. 2(A)) of an insulator, thereby directly supporting the outer diameter reduction portion of the insulator. In addition, a gap for electric discharge may be formed between a ground electrode and a side surface (a surface on a side in a direction perpendicular to the axial line CL) of a front end portion of a center electrode, instead of a front end surface (e.g., a surface on the frontward direction Df side of the first tip 29 in FIG. 1) of the front end portion of the center electrode. The total number of the gaps for electric discharge may be two or more. The resistor 73 may be omitted. A magnetic body may be disposed between the center electrode and a metal terminal in a through hole of the insulator. In addition, instead of the talc 70, any of other members that can be compressed may be used as the buffering member to be disposed in the space SP between the metal shell 50 and the insulator 10.

Although the present invention has been described above based on the embodiments and the modified embodiments, the above-described embodiments of the invention are intended to facilitate understanding of the present invention, but not to limit the present invention. The present invention can be changed and modified without departing from the gist thereof and the scope of the claims and equivalents thereof are encompassed in the present invention.

INDUSTRIAL APPLICABILITY

The present invention is suitably usable for spark plugs.

DESCRIPTION OF REFERENCE NUMERALS

8: front-side packing
10: insulator
11: inner diameter reduction portion
12: through hole (axial hole)
13: rear-side trunk portion
14: large-diameter portion
15: front-side trunk portion
16: outer diameter reduction portion
16L: portion
17: outer diameter reduction portion
19: leg portion
19L: portion
20: center electrode
21: outer layer
22: core portion
23: flange portion
24: head portion
27: axial portion
28: rod portion
29: first tip
30: ground electrode
31: outer layer
32: inner layer
33: proximal end portion
34: distal end portion
37: body portion
39: second tip
40: metal terminal
41: axial portion
48: flange portion
49: cap mounting portion
50: metal shell
50P: intermediate portion
51: tool engagement portion
52: front-side trunk portion
52*m*: rear portion
52*m*L: portion
53: crimp portion (rear end portion)
54: middle trunk portion
55: front end surface
56: inner diameter reduction portion
56L: portion
57: screw portion
57*f*: front end
57*r*: rear end
57*x*: portion
58: buckling portion
59: through hole
61: ring member
61*f*: front end
62: ring member
62*r*: rear end
70: talc
72: first seal portion
73: resistor
74: second seal portion
79: filled portion
79*f*: position
79*r*: position
90: gasket
100: spark plug
200: assembly
300: seating surface
810: first boundary line
820: second boundary line
900: support tool
900*r*: surface
910: through hole
g: gap
L: filling length
T: minimum thickness
F1: force
C1: connection portion
P1: intersection point
C2: connection portion
P2: intersection point
CL: central axis (axial line)
SP: space
CS: cross section
Da: intermediate-portion length
Db: screw length
Dc: outer diameter
Dc: base diameter
De: pitch diameter
Df: front end direction (frontward direction)
Di: inner diameter
Dm: nominal diameter
Dfr: rear end direction (rearward direction)

Having described the invention, the following is claimed:

1. A spark plug comprising:

an insulator having a through hole extending in a direction of an axial line, the insulator including a first outer diameter reduction portion having an outer diameter that reduces from a rear side toward a front side, and a second outer diameter reduction portion positioned rearward of the first outer diameter reduction portion and having an outer diameter that reduces from the front side toward the rear side;

a metal shell disposed on an outer periphery of the insulator and having a through hole into which the insulator is inserted and which extends in the direction of the axial line, the metal shell including an inner diameter reduction portion having an inner diameter that reduces from the rear side toward the front side, the inner diameter reduction portion directly or indirectly supporting the first outer diameter reduction portion of the insulator, a rear end portion positioned rearward of the second outer diameter reduction portion of the insulator so as to form a rear end of the metal shell, the rear end portion being bent radially inward, and a screw portion formed on an outer peripheral surface thereof; and a buffering member filled in a space that is present between the rear end portion of the metal shell and the second outer diameter reduction portion of the insulator and that is enclosed by an inner peripheral surface of the metal shell and an outer peripheral surface of the insulator, wherein $3\ mm^2 \leq L \times T$ is satisfied in a case where:

a length in the direction of the axial line of a filled portion filled with the buffering member is defined as a filling length L;

a thickness, of the screw portion of the metal shell, that is half a difference left after subtraction of an inner diameter of the metal shell from a pitch diameter of the screw portion is defined as an effective thickness; and a minimum value of the effective thickness of a portion, of the screw portion, present rearward of the inner diameter reduction portion is defined as a minimum thickness T.

2. The spark plug according to claim 1, wherein $4\ mm^2 \leq L \times T$ is satisfied.

3. The spark plug according to claim 2, wherein the minimum thickness T is not larger than 1.3 mm.

4. The spark plug according to claim 3, wherein a length in the direction of the axial line of the screw portion is not smaller than 15 mm.

5. The spark plug according to claim 2, wherein a length in the direction of the axial line of the screw portion is not smaller than 15 mm.

6. The spark plug according to claim 1, wherein the minimum thickness T is not larger than 1.3 mm.

7. The spark plug according to claim 6, wherein a length in the direction of the axial line of the screw portion is not smaller than 15 mm.

8. The spark plug according to claim 1, wherein a length in the direction of the axial line of the screw portion is not smaller than 15 mm.

* * * * *